US011250990B2

(12) United States Patent
Zhang et al.

(10) Patent No.: US 11,250,990 B2
(45) Date of Patent: Feb. 15, 2022

(54) HIGH-VOLTAGE TRANSFORMER AND ELECTRONIC POWER APPARATUS

(71) Applicant: Delta Electronics (Shanghai) CO., LTD, Shanghai (CN)

(72) Inventors: Quanliang Zhang, Shanghai (CN); Min Zhou, Shanghai (CN); Shizhong Guo, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 107 days.

(21) Appl. No.: 16/856,682

(22) Filed: Apr. 23, 2020

(65) Prior Publication Data

US 2020/0251278 A1 Aug. 6, 2020

Related U.S. Application Data

(63) Continuation-in-part of application No. 15/869,452, filed on Jan. 12, 2018, now Pat. No. 10,886,054.

(30) Foreign Application Priority Data

Jan. 25, 2017 (CN) ..... 201720104174.1
May 24, 2019 (CN) ..... 201920768057.4

(51) Int. Cl.
*H01F 38/42* (2006.01)
*H01F 27/28* (2006.01)
(Continued)

(52) U.S. Cl.
CPC ..... *H01F 38/42* (2013.01); *H01F 27/2804* (2013.01); *H01F 27/324* (2013.01); *H01F 27/36* (2013.01)

(58) Field of Classification Search
CPC .... H01F 38/42; H01F 27/2804; H01F 27/324; H01F 27/36
See application file for complete search history.

(56) References Cited

U.S. PATENT DOCUMENTS 4,459,575 A * 7/1984 Geissler ..... H01F 27/36 336/84 R
4,586,015 A * 4/1986 Takahara ..... H01F 27/36 336/84 C
(Continued)

FOREIGN PATENT DOCUMENTS

CN 204010993 U * 12/2014
CN 204010993 U 12/2014
(Continued)

OTHER PUBLICATIONS

The USNOA issued Sep. 18, 2020 by the USPTO.
The Non-final OA issued Feb. 21, 2020 by the USPTO.

*Primary Examiner* — Elvin G Enad
*Assistant Examiner* — Malcolm Barnes
(74) *Attorney, Agent, or Firm* — Qinghong Xu

(57) ABSTRACT

A high-voltage transformer includes a magnetic core; at least a secondary coil unit including at least one secondary winding; at least a primary coil unit, comprising at least one primary winding and a first insulating portion, the first insulating portion forming at least one through hole, the primary winding encircling the through hole and being wrapped by the first insulating portion and fixed in the first insulating portion, the magnetic core passing through the through hole, a shielding layer being formed on a surface of the first insulating portion, and the shielding layer being used for connecting a safety ground; a second insulating portion formed by extending the first insulating portion; a first retaining wall presented in a closed ring shape, arranged on an end periphery of the second insulating portion; and a second retaining wall arranged in the first retaining wall.

17 Claims, 19 Drawing Sheets

(51) Int. Cl.
*H01F 27/32* (2006.01)
*H01F 27/36* (2006.01)

(56) References Cited

U.S. PATENT DOCUMENTS 4,660,014 A 4/1987 Wenaas et al.
4,864,265 A * 9/1989 Peoples ..... H01F 27/36 336/5
6,187,410 B1 * 2/2001 Takahashi ..... B29C 45/16 428/212
6,445,269 B1 * 9/2002 Sylvain ..... H01F 41/127 336/84 R
9,640,314 B2 * 5/2017 Singh ..... H01F 27/23
2002/0057170 A1 * 5/2002 Skinner ..... H01F 27/324 336/198
2006/0200971 A1 9/2006 Lanoue et al.
2008/0211611 A1 * 9/2008 Hanov ..... H01F 27/327 336/60
2010/0085775 A1 * 4/2010 Niess ..... H01F 27/36 363/15
2010/0127815 A1 5/2010 Damnjanovic
2010/0301981 A1 * 12/2010 Zeng ..... H01F 27/2885 336/105
2013/0113598 A1 5/2013 Murillo et al.
2014/0118946 A1 * 5/2014 Tong ..... H01F 27/2876 361/704
2015/0028989 A1 1/2015 De Leon

FOREIGN PATENT DOCUMENTS

CN 204577237 U 8/2015
CN 204946669 U * 1/2016
CN 204946669 U 1/2016
JP S5882512 A 5/1983
WO 2015062838 A1 5/2015

* cited by examiner

HIGH-VOLTAGE TRANSFORMER AND ELECTRONIC POWER APPARATUS

CROSS REFERENCE

This application is a Continuation-In-Part application of U.S. Ser. No. 15/869,452, with filing date of Jan. 12, 2018, which is based upon and claims priority to Chinese Patent Application No. 201720104174.1, filed on Jan. 25, 2017 and this application also claims priority of Chinese Patent Application No. 201920768057.4, filed on May 24, 2019, the entire contents thereof are incorporated herein by reference.

TECHNICAL FIELD

The present disclosure relates to a high-voltage transformer and an electronic power apparatus.

BACKGROUND

In an existing power distribution network, a high voltage, for example above 2 kV (kilovolt) in China, is subject to voltage decrease by means of a distribution transformer and then supplied to various loads for use. Therefore, in such a power distribution network, the distribution transformer is one of important parts. A traditional distribution transformer has many defects, for example, large size, heavy weight, great no-load loss, failed automatic isolation from fault, and susceptible to interference of power grid, etc.

At present, new technical solutions are sought in the industries. For example, a power electrode transformer (PET) is employed to replace a power frequency distribution transformer to remedy defects and implement high power density, miniaturization, high efficiency and intelligentization of a power distribution system. One core part of the PET is high-frequency high-voltage transformer, which is used for electrical energy conversion and electrical isolation between a high-voltage side and a low-voltage side.

Generally, the high-frequency high-voltage transformer is manufactured by the following three modes. In the first mode, the high-frequency high-voltage transformer may use air as main insulation against ground, which is similar to a power frequency dry-type transformer. However, larger insulation size is required because the insulation strength of air is relatively weak. The first mode is disadvantageous to the increase of power density. Also a high-voltage potential appears on the external surface of the transformer, so that it is required to take a safety distance into account. In the second mode, the high-frequency high-voltage transformer may use oil as main insulation against ground, which is similar to an oil-immersed transformer. However, in the second mode a shell and flammable insulating oil are required, and thus a potential safety hazard exists in an indoor environment. In the third mode, an integrated epoxy resin cast transformer is manufactured using a vacuum casting process, where a winding and a magnetic core are entirely cast into a resin. In case of an insulation fault, safety isolation is hard to make between the high-voltage side and the low-voltage side, and thus a potential safety hazard exists. Furthermore, a high voltage potential appears on the external surface of the transformer, so that it is required to take a safety distance into account, which is disadvantageous to the increase of power density.

The above-mentioned information disclosed in this Background section is only for the purpose of enhancing the understanding of background of the present disclosure and may therefore include information that does not constitute a prior art that is known to those of ordinary skill in the art.

SUMMARY

According to an aspect of the present disclosure, there is provided a high-voltage transformer, which includes a magnetic core; at least a secondary coil unit, comprising at least one secondary winding; at least a primary coil unit, comprising at least one primary winding and a first insulating portion, the first insulating portion forming at least one through hole, the primary winding encircling the through hole and being wrapped by the first insulating portion and fixed in the first insulating portion, the magnetic core passing through the through hole, a shielding layer being formed on a surface of the first insulating portion, and the shielding layer being used for connecting a safety ground; a second insulating portion formed by extending the first insulating portion in a direction away from the primary coil unit, wherein the primary coil unit is provided with two outgoing lines, ends of the outgoing lines are provided with connection terminals, and the outgoing lines and at least a part of the connection terminals are embedded in the second insulating portion; a first retaining wall presented in a closed ring shape, arranged on an end periphery of the second insulating portion, and extending in a direction away from the primary coil unit; and a second retaining wall arranged in the first retaining wall, and having one end connected to the second insulating portion and the other end extending in a direction away from the primary coil unit, wherein the second retaining wall is higher than the connection terminal and partitions the two connection terminals.

According to another aspect of the utility model, there is provided a high-voltage transformer, which includes a secondary coil unit, comprising at least one secondary winding; a primary coil unit, comprising at least one primary winding and a first insulating portion, the first insulating portion forming at least one through hole, the at least one primary winding encircling the at least one through hole and being wrapped by the first insulating portion and fixed in the first insulating portion, a shielding layer being formed on a surface of the first insulating portion, and the shielding layer being used for connecting a safety ground; a second insulating portion formed by extending the first insulating portion in a direction away from the primary coil unit, wherein the primary coil unit is provided with two outgoing lines, the ends of the outgoing lines are provided with connection terminals, and the outgoing lines and at least a part of the connection terminals are embedded in the second insulating portion; a first retaining wall presented in a closed ring shape, arranged on the end periphery of the second insulating portion, and extending in a direction away from the primary coil unit; and a second retaining wall arranged in the first retaining wall, and having one end connected to the second insulating portion and the other end extending in a direction away from the primary coil unit, wherein the second retaining wall is higher than the connection terminal and partitions the two connection terminals.

According to another aspect of the present disclosure, there is provided an electronic power apparatus, which includes a high-voltage transformer. The high-voltage transformer includes a magnetic core, a secondary coil unit, and a primary coil unit. The secondary coil unit includes at least one secondary winding. The primary coil unit includes at least one primary winding and a first insulating portion. The first insulating portion forms at least one through hole. The at least one primary winding encircle at least one of the through hole and is wrapped by the first insulating portion and fixed in the first insulating portion. The magnetic core passes through at least one of the through hole. A shielding layer is formed on a surface of the first insulating portion, and the shielding layer is connected to a safety ground.

BRIEF DESCRIPTION OF THE DRAWINGS

The above and other features and advantages of the present disclosure will become more apparent from the detailed description of exemplary embodiments with reference to the drawings, in which.

Figure 1:
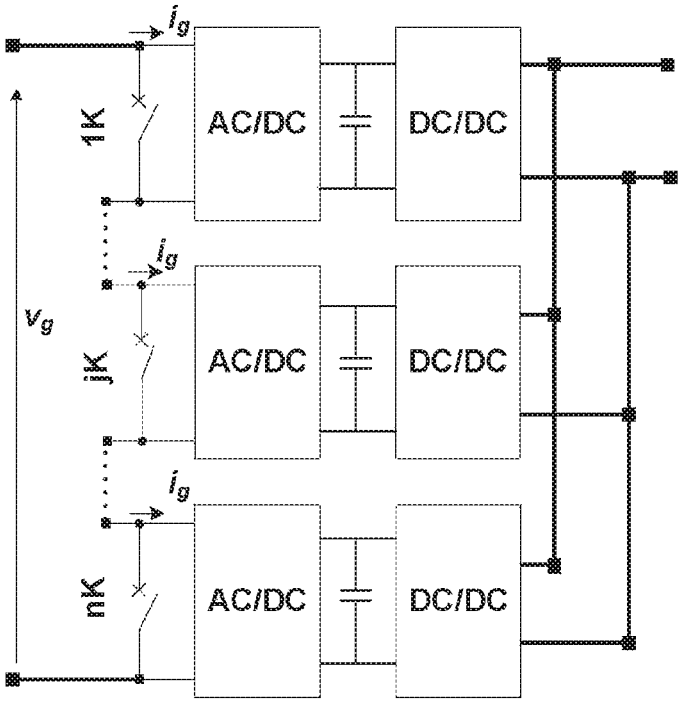
FIG. 1 is a circuit architecture diagram of a PET.

In the drawings, primary coil unit 11; shielding layer 101; first insulating portion 102; primary winding 103; gap 1010; through hole 110; magnetic core 13; first column 131; second column 132; grounded terminal 20; secondary winding 201; and secondary coil unit 21; 501 outgoing line; 502 connection terminal; 53 second insulating portion; 54 first retaining wall; 55 second retaining wall; 56 third retaining wall.

DETAILED DESCRIPTION

Exemplary embodiments will be described more comprehensively by referring to accompanying drawings. However, the exemplary embodiments may be carried out in various manners, and shall not be interpreted as being limited to the embodiments set forth herein; instead, providing these embodiments will make the present disclosure more comprehensive and complete, and will fully convey the conception of the exemplary embodiments to those skilled in the art. Throughout the drawings, similar reference signs indicate the same or similar structures, and their detailed description will be omitted.

Figure 2:
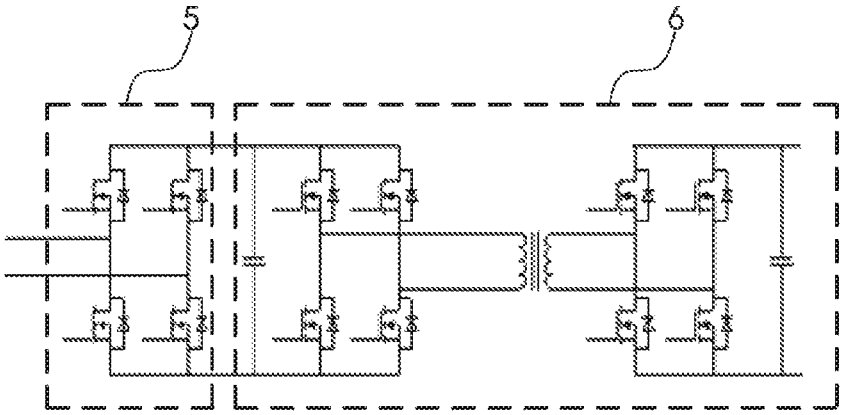
FIG. 2 is a schematic circuit diagram of a module in the circuit architecture diagram of the PET as shown in FIG. 1.

Reference is made to FIG. 1 and FIG. 2. As shown in FIG. 1, the PET is a multi-module input-series/output-parallel system architecture. The input current is marked as ig. Each module may include, for example, an AD/DC unit, a DC bus, and a DC/DC unit, which are sequentially connected. Bypass switches 1K to nK may be connected with the n modules. As shown in FIG. 2, the module includes cascade-connected AC/DC unit 5 and DC/DC unit 6. The DC/DC unit includes a core component, namely a high-frequency high-voltage transformer, which is used for electrical energy conversion and electrical isolation between a high voltage side and a low voltage side.

The High-Voltage Transformer According to the First Embodiment

Figure 3:
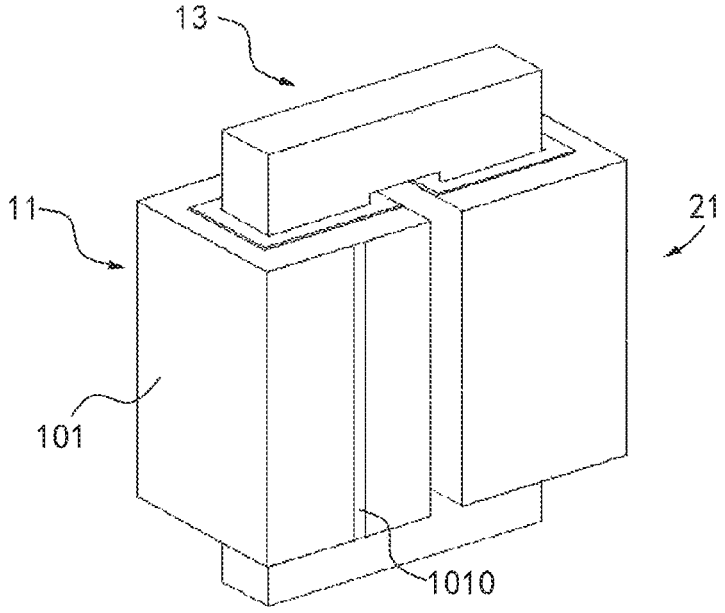
FIG. 3 is a perspective view of a high-voltage transformer according to a first embodiment of the present disclosure.
Figure 4:
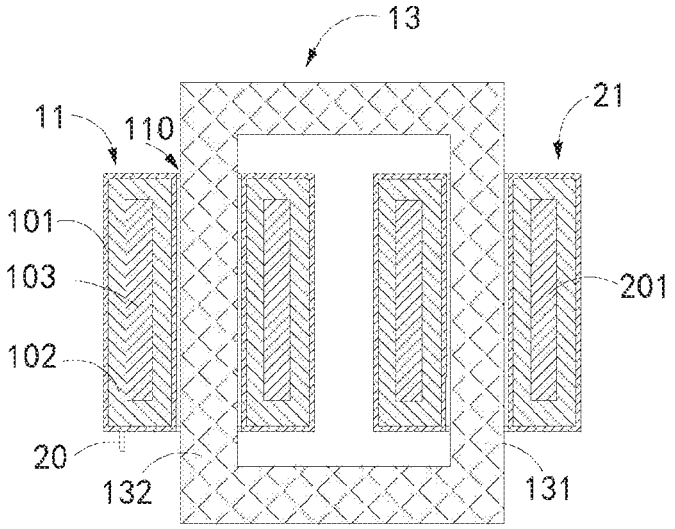
FIG. 4 is a cross-sectional view along the longitudinal direction of the high-voltage transformer as shown in FIG. 3.
Figure 5:
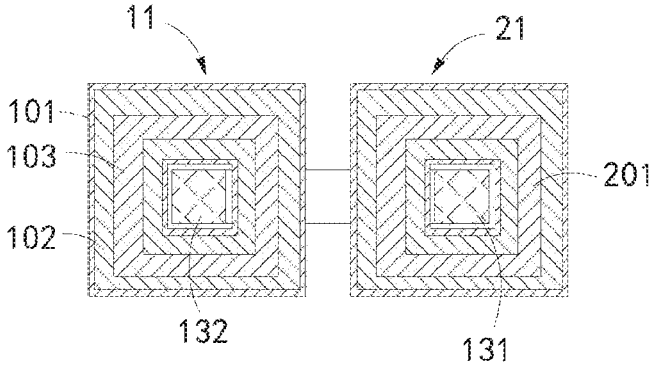
FIG. 5 is a cross-sectional view along the transversal direction of the high-voltage transformer as shown in FIG. 3.

Referring to FIG. 3. FIG. 4 and FIG. 5, FIG. 3 is a structural diagram of the high-voltage transformer according to the first embodiment of the present disclosure; FIG. 4 is a cross-sectional view along the longitudinal direction of the high-voltage transformer as shown in FIG. 3; and FIG. 5 is a cross-sectional view along the transversal direction of the high-voltage transformer as shown in FIG. 3. As shown in FIG. 3 to FIG. 5, the high-voltage transformer according to the first embodiment includes a primary coil unit 11, a secondary coil unit 21, and a magnetic core 13. The primary coil unit 11 includes a primary winding 103 and a first insulating portion 102.

The first insulating portion 102 may be made from an insulating material such as a resin, into which a through hole 110 is formed. In other embodiments, the number of the through hole 110 in the first insulating portion 102 is not limited to one, which may be two or even more. The through hole 110 is configured to be passed through by the magnetic core.

The primary winding 103 encircles the through hole 110 and is wrapped by the first insulating portion 102 and fixed in the first insulating portion 102. A shielding layer 101 is formed on a surface of the first insulating portion 102. A maximum voltage against ground of the primary coil unit 11 may be greater than 2 kV (kilovolt), for example, 3 kV, 6 kV, 10 kV, 20 kV, and so on. The first insulating portion is advantageous for designing voltage difference between the primary voltage and the secondary voltage. A ratio of the maximum voltage against ground of the primary coil unit 11 to a maximum voltage against ground of the secondary coil unit 21 may be not less than 5.

Figure 6:
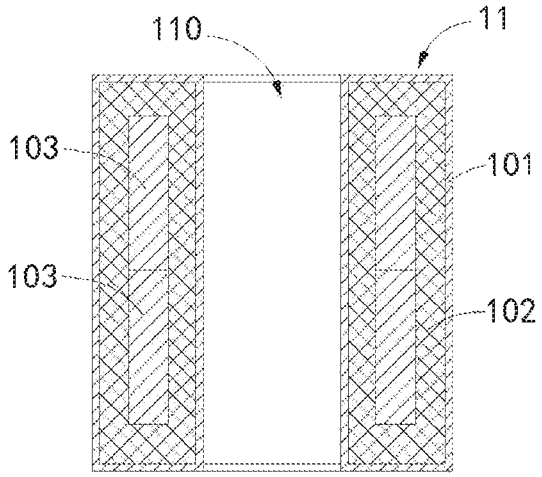
FIG. 6 is a cross-sectional view along the longitudinal direction of another structure of a primary winding in the high-voltage transformer as shown in FIG. 3.

Referring to FIG. 6, which is a cross-sectional view along the longitudinal direction of another structure of a primary winding unit in the high-voltage transformer as shown in FIG. 3, the primary coil unit 11 includes two series-connected primary windings 103. In the present disclosure, the number of the primary windings 103 in the primary coil unit 11 may be more than one, and a plurality of the primary windings 103 may be directly connected in parallel with each other, or directly connected in series with each other, or mutually independent and not directly connected with each other, but the present disclosure is not limited thereto.

The shielding layer 101 may cover all the surfaces of the first insulating portion 102, including an internal surface (the surface surrounding through hole) and an external surface and so on. The shielding layer 101 also may cover a part of the surfaces of the first insulating portion 102. Generally, to obtain a better shielding effect, the shielding layer 101 may cover more than 90% of the surface of the first insulating portion 102. The shielding layer 101 may be a copper foil, an aluminium foil, a zinc layer, a conductive silver lacquer layer, or a silver-copper alloy conductive lacquer layer and the like affixed to the surface of the first insulating portion 102, for example, an aluminium foil having a thickness of 0.2 mm or a zinc layer having a thickness of 18 um. The shielding layer 101 also may be a metal film such as a conductive gold film formed on the surface of the first insulating portion 102 by affixing, electroplating, evaporating, casting or spraying, etc. However, the present disclosure is not limited thereto.

The shielding layer 101 may be used for connecting a safety grounded point. The safety grounded point may be formed by, for example, a conductor buried into the ground, so as to reduce a high voltage potential of the primary coil unit and improve the safety performance of the high-voltage transformer. In some embodiments, for ease of connecting the safety ground, the shielding layer 101 is provided with a grounded terminal 20 (seeing FIG. 4). The grounded terminal 20 is used for connecting the shielding layer 101 to the safety ground in the form such as a surface-mounted grounded welding pad or a pin.

In some embodiments, the shielding layer 101 has a gap to prevent the shielding layer 101 from forming a closed conductive circuit. For example, the shielding layer 101 in FIG. 3 is provided with a gap 1010.

The secondary coil unit 21 may include at least one secondary winding 201, which may be directly connected in series with each other, or indirectly connected in series with each other, or directly connected in parallel with each other, or indirectly connected in parallel with each other, but the present disclosure is not limited thereto. In the first embodiment, the secondary coil unit 21 may be the same as the primary coil unit 11 in structure, including a secondary winding 201 which is fixed in and wrapped by an insulating material. The insulating material has a through hole, the secondary winding 201 encircles the through hole, and the insulating material may be entirely wrapped or partly covered with a shielding layer.

In the first embodiment, the magnetic core 13 includes a first column 131 and a second column 132. In other embodiments, the number of the column included in the magnetic core 13 is not limited to two. An air gap (not shown in the figure) may be arranged on the column or other positions the magnetic core 13. The number and position of the air gaps may be designed as needed.

The secondary coil unit 21 is arranged at the first column 131, that is, the first column 131 passes through the through hole of the secondary coil unit 21. The primary coil unit 11 is arranged at the second column 132, that is, the second column 132 passes through the through hole 110 of the primary coil unit 11.

In some embodiments, the primary coil unit 11 and/or the secondary coil unit 21 may be provided with pins passing through the shielding layer 101 for connecting the primary winding/secondary winding to other devices.

In the assembled high-voltage transformer, the primary coil unit 11, the secondary coil unit 21 and the magnetic core 13 may be exposed to air, so that heat dissipation mode is simplified, and heat dissipation effect is good.

In the first embodiment of the high-voltage transformer, the shielding layer 101 is electrically connected to the safety ground, so that a zero volt potential appears on the surface of the high-voltage transformer. Therefore, the safety performance is improved, and also other devices may be arranged nearby the primary coil unit 11, so that the high-voltage transformer is compact in structure, which is advantageous for enhancing power density and decreasing size. Furthermore, the high-voltage transformer also may be arranged nearby other devices, allowing the use to be more flexible and convenient.

The High-Voltage Transformer According to the Second Embodiment

Figure 7:
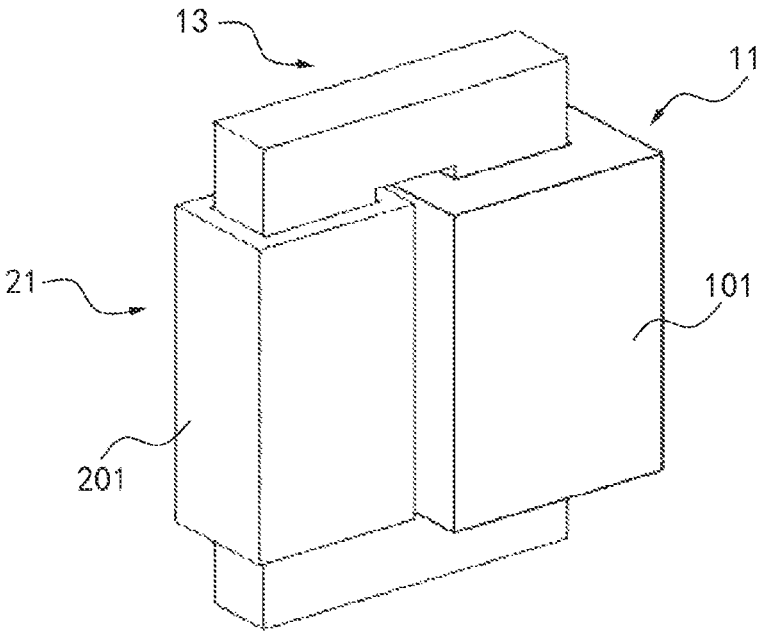
FIG. 7 is a structural diagram of a high-voltage transformer according to a second embodiment of the present disclosure.
Figure 8:
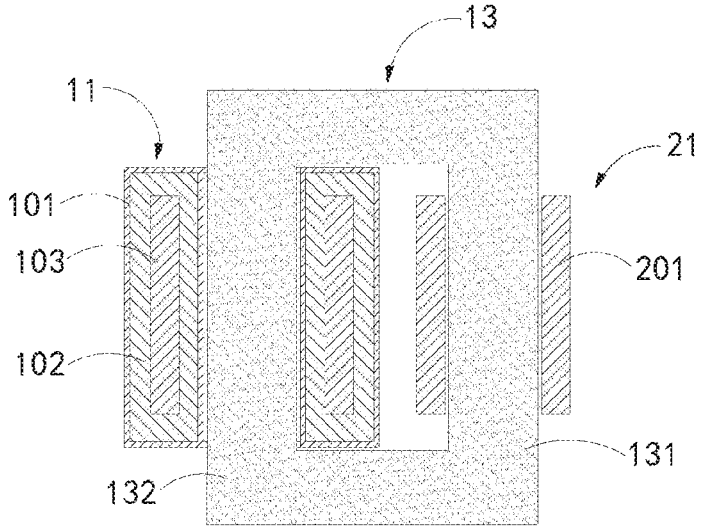
FIG. 8 is a cross-sectional view along the longitudinal direction of the high-voltage transformer as shown in FIG. 7.

Referring to FIG. 7 and FIG. 8, FIG. 7 is a structural diagram of the high-voltage transformer according to the second embodiment of the present disclosure; and FIG. 8 is a cross-sectional view along the longitudinal direction of the high-voltage transformer as shown in FIG. 7. As shown in FIG. 7 and FIG. 8, the difference between the high-voltage transformer according to the second embodiment and the high-voltage transformer according to the first embodiment mainly resides in that:

the secondary coil unit 21 may include a secondary winding 201 but not include the first insulating portion and the shielding layer. The secondary coil unit 21 generally is at a low voltage and thus is relatively safe. Furthermore, when the secondary coil unit 21 does not include the first insulating portion or the shielding layer, it is advantageous to enhancing power density and decreasing size of the high-voltage transformer. The size of the high-voltage transformer in this embodiment may be decreased to about 50% of that of a traditional high-voltage transformer.

Other structures of the high-voltage transformer according to the second embodiment are substantially the same as those of the high-voltage transformer according to the first embodiment, and thus their detailed descriptions are omitted herein.

The High-Voltage Transformer According to the Third Embodiment

Figure 9:
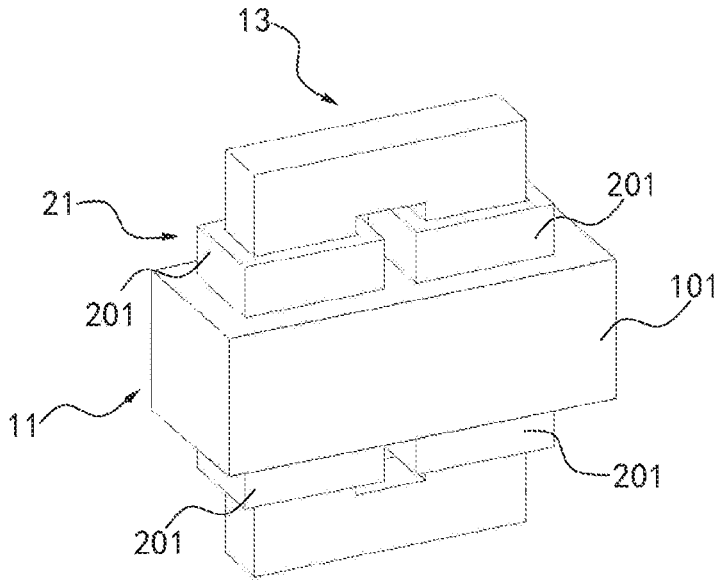
FIG. 9 is a structural diagram of a high-voltage transformer according to a third embodiment of the present disclosure.
Figure 10:
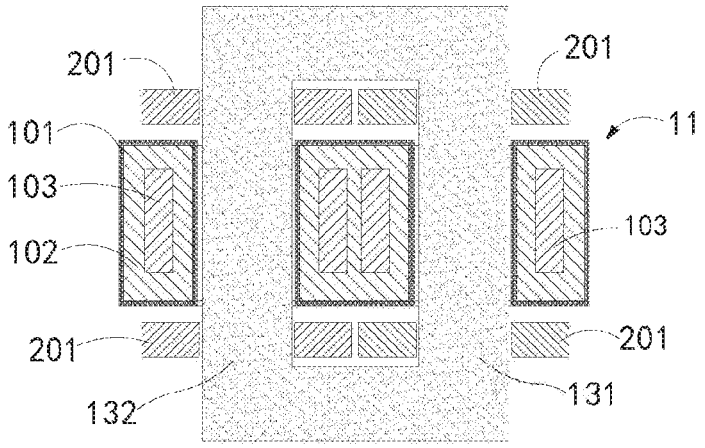
FIG. 10 is a cross-sectional view along the longitudinal direction of the high-voltage transformer as shown in FIG. 9.

Referring to FIG. 9 and FIG. 10, FIG. 9 is a structural diagram of the high-voltage transformer according to the third embodiment of the present disclosure; and FIG. 10 is a cross-sectional view along the longitudinal direction of the high-voltage transformer as shown in FIG. 9. As shown in FIG. 9 and FIG. 10, the difference between the high-voltage transformer according to the third embodiment and the high-voltage transformer according to the first embodiment mainly resides in that:

The primary coil unit 11 includes two through holes and two primary windings 103, where the two primary windings 103 in the first insulating portion may be physically independent and not connected. The first insulating portion 102 wraps and fixes the two primary windings 103 therein. The first insulating portion 102 forms the two through holes, and the two primary windings 103 respectively encircle the corresponding through holes. However, in other embodiments, the two primary windings 103 may encircle the same through hole, the present disclosure is not limited thereto.

The first column 131 and the second column 132 of the magnetic core 13 respectively pass through the corresponding through holes. The two primary windings 103 may further be connected in parallel or series by outer connections.

The secondary coil unit 21 may include four mutually independent secondary windings 201, but may not include the first insulating portion and the shielding layer. Two secondary windings 201 are wound around the first column 131 and positioned at two sides of the primary winding 103 of the primary coil unit, and a gap may be provided between the secondary winding 201 and the primary winding 103. The other two secondary windings 201 are wound around the second column 132 and positioned at two sides of the primary winding 103 of the primary coil unit, and a gap may be provided between the secondary winding 201 and the primary winding 103. A projection of the secondary winding 201 of the secondary coil unit on the magnetic core is not overlapped with that of the primary winding 103 of the primary coil unit on the magnetic core.

Figure 11:
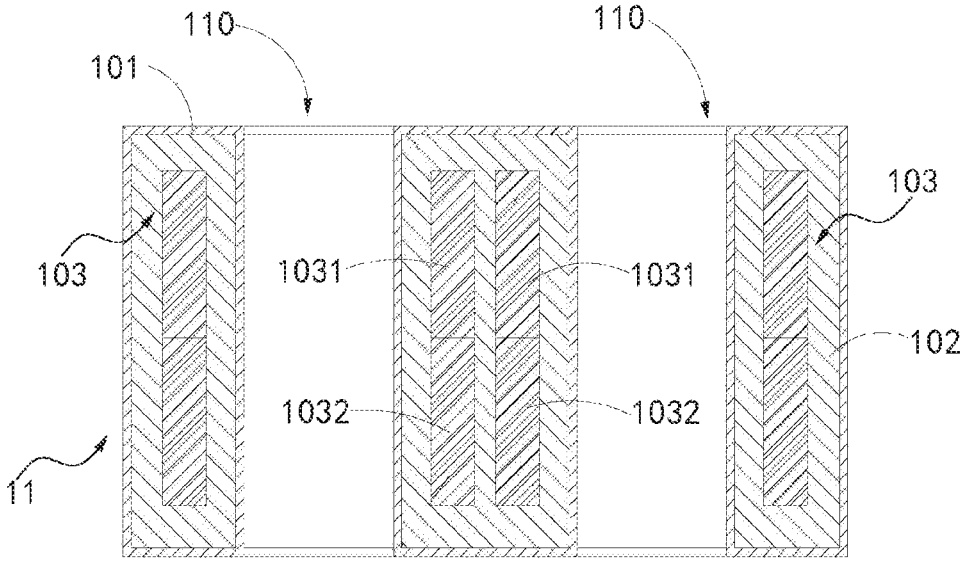
FIG. 11 is a cross-sectional view along the longitudinal direction of another structure of a primary winding in the high-voltage transformer as shown in FIG. 10.

The primary winding unit may have other structures. As shown in FIG. 11, FIG. 11 is a cross-sectional view along the longitudinal direction of another structure of a primary winding unit in the high-voltage transformer as shown in FIG. 10. As shown in FIG. 11, each of the primary windings 103 may further include two sub-windings 1031 and 1032 connected in series. Of course, the number of the sub-windings is not limited to two.

Other structures of the high-voltage transformer according to the third embodiment are substantially the same as those of the high-voltage transformer according to the first embodiment, and thus their detailed descriptions are omitted herein.

The High-Voltage Transformer According to the Fourth Embodiment

Figure 12:
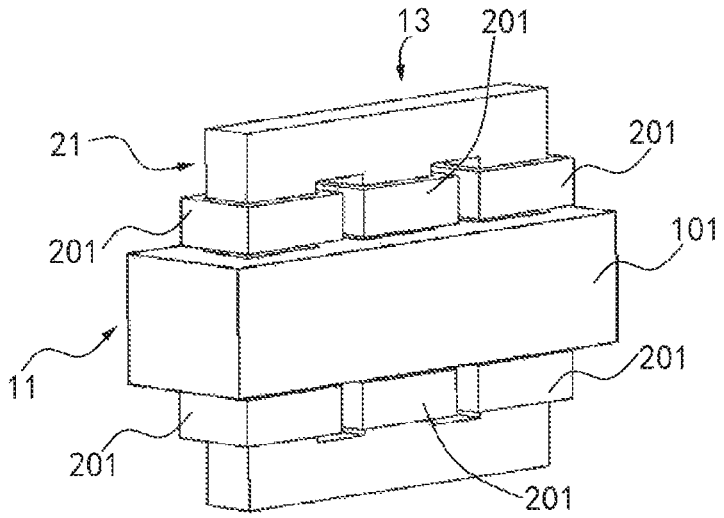
FIG. 12 is a structural diagram of a high-voltage transformer according to a fourth embodiment of the present disclosure.

Referring to FIG. 12, FIG. 12 is a structural diagram of the high-voltage transformer according to the fourth embodiment of the present disclosure. As shown in FIG. 12, the difference between the high-voltage transformer according to the fourth embodiment and the high-voltage transformer according to the third embodiment mainly resides in that:

the first insulating portion of the primary coil unit 11 has three through holes, the primary coil unit 11 includes three primary windings arranged respectively surrounding around the three through holes; the secondary coil unit 21 includes three pairs of mutually independent secondary windings (i.e. six secondary windings); and the magnetic core 13 includes three columns, each of the columns passes through one corresponding through hole of the primary coil unit 11 and a pair of secondary windings, and each pair of secondary windings are arranged at two sides of the primary winding.

Other structures of the high-voltage transformer according to the fourth embodiment are substantially the same as those of the high-voltage transformer according to the third embodiment, and thus their detailed descriptions are omitted herein.

The High-Voltage Transformer According to the Fifth Embodiment

Figure 13:
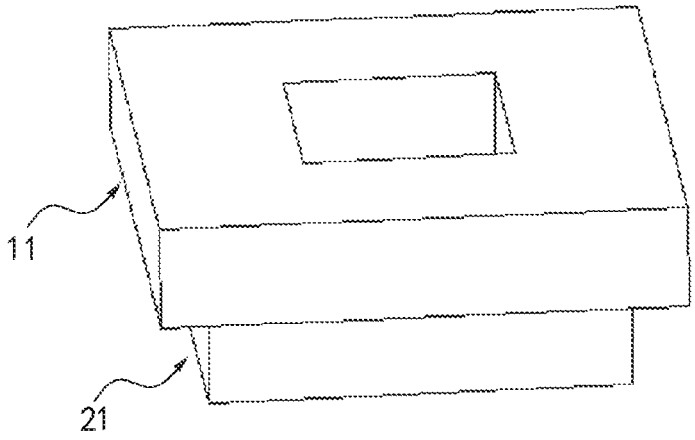
FIG. 13 is a structural diagram of the high-voltage transformer according to the fourth embodiment of the present disclosure.
Figure 14:
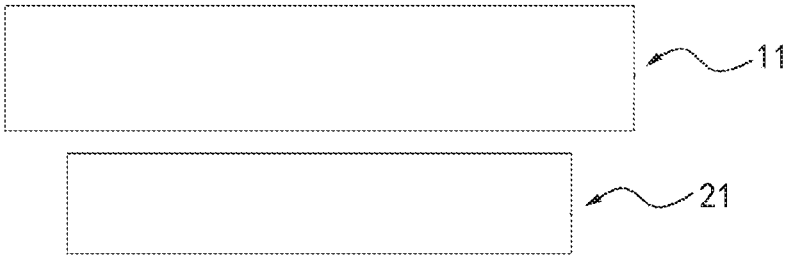
FIG. 14 is a front view of the high-voltage transformer as shown in FIG. 13.

Referring to FIG. 13 and FIG. 14. FIG. 13 is a structural diagram of the high-voltage transformer according to the fifth embodiment of the present disclosure; and FIG. 14 is a cross-sectional view along the longitudinal direction of the high-voltage transformer as shown in FIG. 13.

As shown in FIG. 13 and FIG. 14, the high-voltage transformer according to the fifth embodiment includes a primary coil unit 11 and a secondary coil unit 21. The primary coil unit 11 includes at least one primary winding 103 and a first insulating portion 102. The first insulating portion 102 forms at least one through hole 110, the at least one primary winding 103 encircle at least one of the through hole 110 and is wrapped by the first insulating portion 102 and fixed in the first insulating portion 102. The magnetic core 13 passes through at least one through hole 110. A shielding layer 101 is formed on the surface of the first insulating portion 102, and the shielding layer 101 is used for connecting a safety ground. The secondary coil unit 21 includes at least one secondary winding 201.

The primary coil unit 11 and the secondary coil unit 21 in the high-voltage transformer according to the fifth embodiment may be the same as those in the high-voltage transformer according to the foregoing embodiments. The high-voltage transformer according to the fifth embodiment does not include a magnetic core, and a magnetic field interlinks the primary winding and the secondary winding through air.

In the high-voltage transformer of the present disclosure, the primary winding of the primary coil unit is wrapped by the first insulating portion and fixed in the first insulating portion. That is, the first insulating portion plays roles in fixing and insulating the primary winding, which is advantageous to improving the safety performance of the high-voltage transformer. Further, a shielding layer is formed on the surface of the first insulating portion, and the shielding layer can be electrically connected to a safety ground, so that a high voltage potential of the primary coil unit is reduced, a low voltage potential or zero volt potential appears on the surface of the high-voltage transformer, and the safety performance of the high-voltage transformer is significantly improved. In another aspect, the low voltage potential or zero volt potential appears on the primary coil unit. Therefore, other parts such as the secondary coil unit or devices such as capacitors may be arranged nearby or even in direct contact with the primary coil unit, so that the power density can be significantly enhanced.

Electronic Power Apparatus

The electronic power apparatus of the present disclosure includes a high-voltage transformer. The high-voltage transformer includes a magnetic core, a primary coil unit, and a secondary coil unit. The secondary coil unit includes at least one secondary winding. The primary coil unit includes at least one primary winding and a first insulating portion. The first insulating portion forms at least one through hole. The at least one primary winding encircle the through hole and is wrapped by the first insulating portion and fixed in the first insulating portion. The magnetic core passes through at least one of the through hole. A shielding layer is formed on the surface of the first insulating portion, and the shielding layer is connected to a safety ground.

In some other embodiments, the electronic power apparatus also may not include the magnetic core.

The shielding layer is connected to a safety ground, which reduces the potential on the surface of the electronic power apparatus or even reduces the potential to zero, thereby greatly improving the safety performance.

At present, there are generally several methods for outgoing wires of medium and high voltage transformers, that is, firstly, silicon gel wires are directly led out of a solid insulation part. Since silicon gel wires and solid insulation part have very high insulation strength, insulation strength to ground can be satisfied. However, due to combination of the silicon gel wires of the solid insulation part, existence of air at the interface and inside the silicon gel wires cannot be avoided, resulting in hidden dangers of partial discharge of the products and unqualified long-term aging capability of the products. Secondly, porcelain outgoing lines are the common outgoing lines for oil-immersed insulation products, which can meet the requirement of withstand voltage of the product due to a strong insulation strength of the insulating oil. Since such types of design requires a larger space, i.e. an length of the outgoing line is greater than or equal to the electrical clearance, the overall power density of the product can be reduced. At the same time, due to requirement for filling oil, sealing and fire-fighting can also restrict the application of the products of such types. Thirdly, an integral epoxy column outgoing line is directly led out of the inside of the coil, and an external insulation part of the column outgoing line and a body insulation part are integrally formed. By using the high insulation strength of the solid insulation, this type of product can meet the overall insulation requirements of the product, and also can avoid the disadvantages such as joints and different insulation mediums, therefore a better insulation performance can be realized. However, similar to the porcelain outgoing line, it requires a larger space, i.e. the length of the outgoing line is greater than or equal to the electrical clearance, so the overall power density of the product can be reduced.

Figure 15:
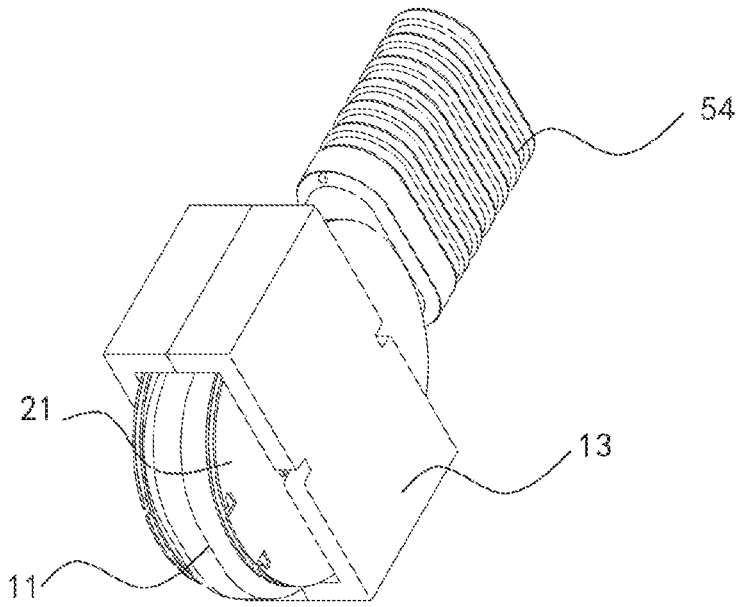
FIG. 15 is a perspective structural view of an embodiment of the high voltage transformer of the present disclosure.
Figure 16:
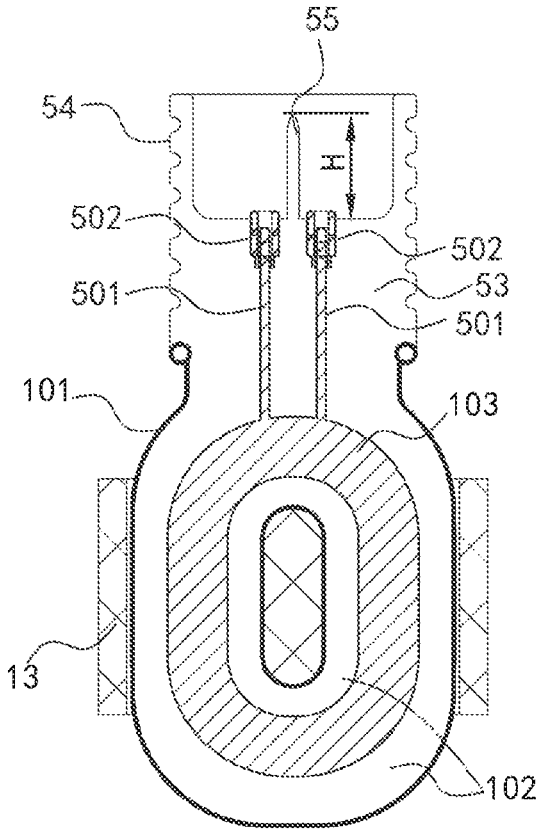
FIG. 16 is a longitudinal sectional view of the high voltage transformer as shown in FIG. 15.
Figure 17:
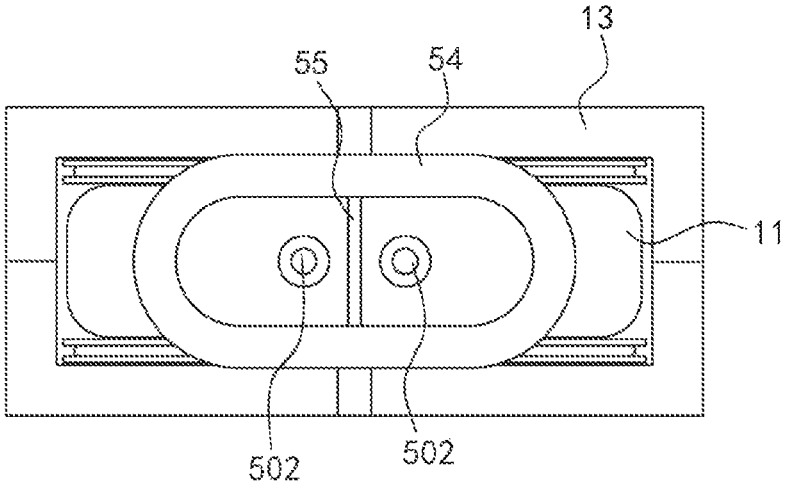
FIG. 17 is a top view of the high voltage transformer as shown in FIG. 15.

Referring to FIGS. 15 to 17, FIG. 15 is a schematic perspective structural view of an embodiment of a high voltage transformer of the present disclosure. FIG. 16 is a longitudinal sectional view of the high voltage transformer as shown in FIG. 15. FIG. 17 is a top view of the high voltage transformer as shown in FIG. 15.

According to an embodiment of the present disclosure, a high voltage transformer includes a magnetic core 13, a secondary coil unit 21, a primary coil unit 11, a first insulating portion 102, a second insulating portion 53, a first retaining wall 54 and a second retaining wall 55.

Wherein, the magnetic core 13, the secondary coil unit 21, the primary coil unit 11, and the first insulating portion 102 may be the same as those in the above-described embodiments, which will be omitted herein.

The second insulating portion 53 is formed by extending the first insulating portion 102 in a direction away from the primary coil unit. The second insulating portion 53 may be made of the same material as the first insulating portion 102 and integrally formed with the first insulating portion 102.

The primary coil unit 11 includes two outgoing lines 501 (e.g., the head end and the terminal end of the primary winding 103). For convenience of electrical connection, the ends of the outgoing line 501 are provided with connection terminals 502. The outgoing line 501 and at least a part of the connection terminals 502 are embedded in the second insulating portion 53. The connection terminal 502 may be a concave metal connector and also a convex connecting rod. In other embodiments of the present disclosure, the primary coil unit 11 may further include three or more outgoing lines 501 according to the number and the connecting mode of the primary coils.

The first retaining wall 54 has a closed ring shape and may be made of an insulating material. The first retaining wall 54 is provided on an end periphery of the second insulating portion 53 and extends in a direction away from the primary coil unit 11. The first retaining wall 54 may be made of the same material as the second insulating portion 53 and integrally formed with the second insulating portion 53. The connection terminal 502 is surrounded by the first retaining wall 54. The first retaining wall 54 is configured to increase an electrical clearance and a creepage distance from the connection terminal 502 to a shielding layer 101, and improve insulation strength of the primary winding 103 to ground.

In some embodiments, an outer surface of the first retaining wall 54 and an outer surface of the second insulating portion 53 may be provided with an umbrella skirt to further increase the creepage distance.

The second retaining wall 55 is disposed in the first retaining wall 54 and may be plate-shaped. A bottom end of the second retaining wall 55 is connected to the second insulating portion 53, and a top end of the second retaining wall 55 extends away from the primary coil unit 11, as shown in FIG. 17. The other two opposite sides of the second retaining wall 55 may be connected to the first retaining wall 54. The second retaining wall 55 may be made of an insulating material. The second retaining wall 55 may be made of the same material as the second insulating portion 53 and integrally formed with the second insulating portion 53. The two connection terminals 502 are separated by the second retaining wall 55, and thereby increasing the creepage distance between the two connection terminals 502.

A height H of the second retaining wall 55 is higher than that of the connection terminals 502, which can increase the electrical clearance between the two connection terminals 502. The first retaining wall 54 and the second retaining wall 55 can improve insulation strength of the high voltage transformer, and can improve the anti-pollution and moisture-proof performance of the high voltage transformer.

Figure 18:
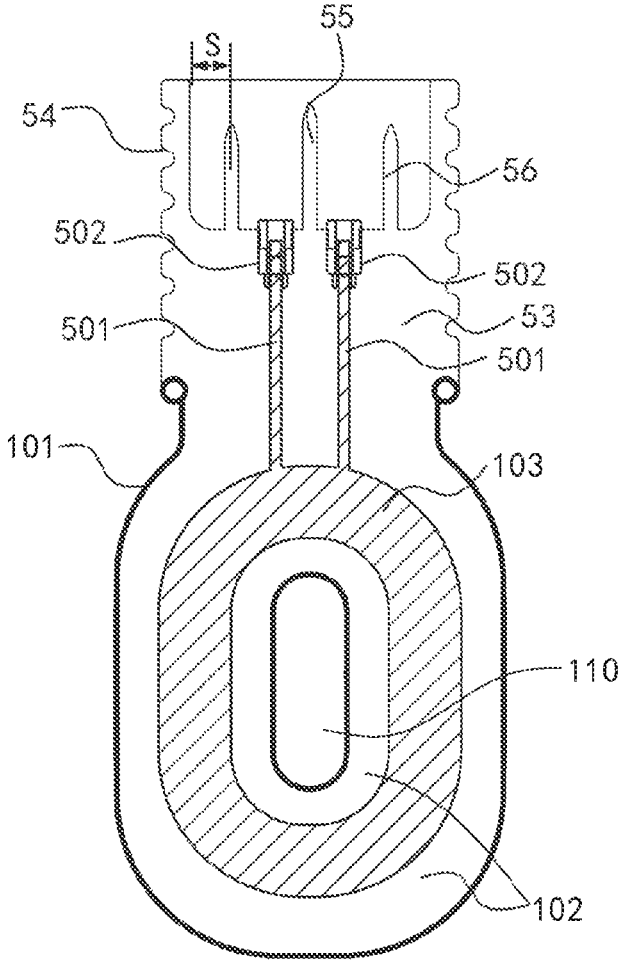
FIG. 18 is a longitudinal sectional view of another embodiment of the high voltage transformer of the present disclosure.
Figure 19:
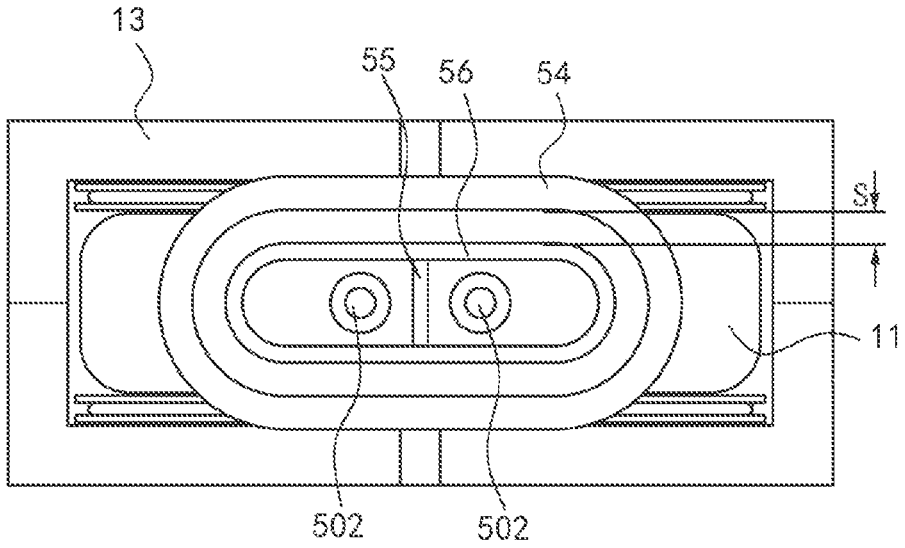
FIG. 19 is a top view of the high voltage transformer as shown in FIG. 18.

Referring to FIGS. 18 and 19, FIG. 18 is a longitudinal sectional view of another embodiment of the high voltage transformer of the present disclosure. For showing a through hole 110 formed in the first insulating portion 102, the magnetic core is removed. FIG. 19 is a top view of the high voltage transformer as shown in FIG. 18. The high voltage transformer of this embodiment further includes a third retaining wall 56 on the basis of the embodiment as shown in FIGS. 15 to 17.

The third retaining wall 56 has a closed ring shape, such as a racetrack shape, an oval shape, a circular shape, etc. The third retaining wall 56 is provided on the end peripheral of the second insulating portion 53 and extends in a direction away from the primary coil unit 11. The third retaining wall 56 may be made of an insulating material. The third retaining wall 56 may be integrally formed with the second insulating portion 53. The height of the third retaining wall 56 is lower than the height of the first retaining wall 54. In other embodiments, the height of the third retaining wall 56 may also be higher than or equal to the height of the first retaining wall 54. The two connection terminals 502 may be enclosed by the third retaining wall 56. The third retaining wall 56 can be configured to further increase the electrical clearance and the creepage distance from the connection terminal 502 to the shielding layer 101, and thus further improving the insulation strength of the primary winding to ground.

The third retaining wall 56 is located in the first retaining wall 54 and has a distance S from the first retaining wall 54. This distance S can facilitate increasing the creepage distance of the connection terminal 502 to the ground.

The high voltage transformer of the present disclosure includes the first insulating portion and the second insulating portion that extends from the first insulating portion, wherein the outgoing line of the primary coil unit is embedded in the second insulating portion, and the second insulating portion is provided with a first retaining wall that surrounds the two outgoing line terminals and a second retaining wall that partitions the two outgoing line terminals. Thus, this can significantly increase the electrical clearance and the creepage distance from the connection terminal to the shielding layer, and can improve the insulation strength of the winding to ground and also improve the anti-pollution and moisture-proof performance of the high voltage transformer.

Relative terms such as "above" or "below" and "front" or "back" may be used in the above embodiments to describe a relative relation between one component and another component of an icon. It is to be understood that when the apparatus of the icon are turned upside down, components described as "above" or "below" and "front" or "back" will become components described as "below" or "above" and "back" or "front". The articles "a", "an", "the", and "at least one" are intended to mean that there are one or more element(s)/constituent part(s)/etc. The terms "comprising", "including" and "having" are intended to be inclusive and mean that there may be additional constituent part(s)/etc. other than the listed constituent part(s). Moreover, the terms "first" and "second" are used merely as labels, and are not intended to impose numerical requirements on their objects.

It is to be understood that the present disclosure is not limited in its application to the details of construction and the arrangement of the components set forth herein. The present disclosure may have other embodiments and can be implemented and carried out in various ways. Variations and modifications of the foregoing are within the scope of the present disclosure. It should be understood that the present disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the present disclosure and will enable those skilled in the art to utilize the present disclosure.

What is claimed is:

1. A high-voltage transformer, comprising:

a magnetic core;

at least a secondary coil unit, comprising at least one secondary winding;

at least a primary coil unit, comprising at least one primary winding and a first insulating portion, the first insulating portion forming at least one through hole, the primary winding encircling the through hole and being wrapped by the first insulating portion and fixed in the first insulating portion, the magnetic core passing through the through hole, a shielding layer being formed on a surface of the first insulating portion, and the shielding layer being used for connecting a safety ground;

a second insulating portion formed by extending the first insulating portion in a direction away from the primary coil unit, wherein the primary coil unit is provided with two outgoing lines, ends of the outgoing lines are provided with connection terminals, and the outgoing lines and at least a part of the connection terminals are embedded in the second insulating portion;

a first retaining wall presented in a closed ring shape, arranged on an end periphery of the second insulating portion, and extending in a direction away from the primary coil unit; and a second retaining wall arranged in the first retaining wall, and having one end connected to the second insulating portion and the other end extending in a direction away from the primary coil unit, wherein the second retaining wall is higher than the connection terminal and partitions the two connection terminals.

2. The high voltage transformer of claim 1, wherein the high voltage transformer further comprises:

a third retaining wall presented in a closed ring shape, arranged on the end periphery of the second insulating portion, and extending in a direction away from the primary coil unit, wherein the third retaining wall is positioned in the first retaining wall and has a distance from the first retaining wall.

3. The high voltage transformer of claim 2, wherein a height of the third retaining wall is higher than, lower than or equal to a height of the first retaining wall.

4. The high voltage transformer of claim 1, wherein an outer surface of the first retaining wall and an outer surface of the second insulating portion are provided with an umbrella skirt.

5. The high voltage transformer of claim 1, wherein the first retaining wall and the second insulating portion are integrally formed; and/or the second retaining wall and the second insulating portion are integrally formed.

6. The high voltage transformer of claim 2, wherein the third retaining wall and the second insulating portion are integrally formed.

7. The high-voltage transformer according to claim 1, wherein the magnetic core comprises a first column and a second column, the secondary coil unit is arranged at the first column, and the primary coil unit is arranged at the second column, wherein the number of the through hole formed by the first insulating portion of the primary coil unit is one, and the second column passes through the through hole.

8. The high-voltage transformer according to claim 1, wherein the magnetic core at least comprises a first column and a second column, the number of the through hole formed by the first insulating portion of the primary coil unit is at least two, and the first column and the second column respectively pass through the two through holes.

9. The high-voltage transformer according to claim 8, wherein the secondary coil unit is arranged at the first column.

10. The high-voltage transformer according to claim 8, wherein the secondary coil unit is arranged at the second column.

11. The high-voltage transformer according to claim 8, wherein a projection of the secondary winding of the secondary coil unit on the magnetic core is not overlapped with that of the primary winding of the primary coil unit on the magnetic core.

12. The high-voltage transformer according to claim 8, wherein the primary coil unit comprises two primary windings, the two primary windings respectively encircle the two through holes; the secondary coil unit comprises four secondary windings, wherein two of the four secondary windings are arranged at two sides of the primary coil unit at the first column, and the other two of the four secondary windings are arranged at two sides of the primary coil unit at the second column.

13. The high-voltage transformer according to claim 1, wherein the shielding layer covers more than 90% of the surface of the first insulating portion.

14. The high-voltage transformer according to claim 1, wherein the shielding layer is provided with a grounded terminal used for connecting the shielding layer to the safety ground.

15. The high-voltage transformer according to claim 1, wherein the shielding layer has a gap to prevent the shielding layer from forming a closed conductive circuit.

16. The high-voltage transformer according to claim 1, wherein the shielding layer covers more than 90% of the surface of the first insulating portion.

17. A high-voltage transformer, comprising:

a secondary coil unit, comprising at least one secondary winding;

a primary coil unit, comprising at least one primary winding and a first insulating portion, the first insulating portion forming at least one through hole, the at least one primary winding encircling the at least one through hole and being wrapped by the first insulating portion and fixed in the first insulating portion, a shielding layer being formed on a surface of the first insulating portion, and the shielding layer being used for connecting a safety ground;

a second insulating portion formed by extending the first insulating portion in a direction away from the primary coil unit, wherein the primary coil unit is provided with two outgoing lines, the ends of the outgoing lines are provided with connection terminals, and the outgoing lines and at least a part of the connection terminals are embedded in the second insulating portion;

a first retaining wall presented in a closed ring shape, arranged on the end periphery of the second insulating portion, and extending in a direction away from the primary coil unit; and a second retaining wall arranged in the first retaining wall, and having one end connected to the second insulating portion and the other end extending in a direction away from the primary coil unit, wherein the second retaining wall is higher than the connection terminal and partitions the two connection terminals.

* * * * *